US006572339B2

(12) United States Patent
Walton et al.

(10) Patent No.: US 6,572,339 B2
(45) Date of Patent: Jun. 3, 2003

(54) POSITIVE DISPLACEMENT FLUID PUMP HAVING IMPROVED FILL CHARACTERISTICS

(75) Inventors: Erlen Ba. Walton, Farmington Hills, MI (US); Dan C. Pasma, South Lyon, MI (US); David B. Ellsworth, Portage, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/822,059

(22) Filed: Mar. 30, 2001

(65) Prior Publication Data

US 2002/0141878 A1 Oct. 3, 2002

(51) Int. Cl.[7] ..... F04B 23/08

(52) U.S. Cl. ..... 417/87; 417/187; 417/151; 418/15

(58) Field of Search ..... 417/87, 151, 187; 418/15, 171

(56) References Cited

U.S. PATENT DOCUMENTS

| | | | | | |
|---|---|---|---|---|---|
| 3,166,018 | A | | 1/1965 | Stedman, Jr. | |
| 3,348,491 | A | | 10/1967 | Stephens et al. | |
| 3,563,674 | A | * | 2/1971 | Moffat et al. | 417/151 |
| 3,736,072 | A | * | 5/1973 | Turner et al. | 417/87 |
| 3,922,113 | A | * | 11/1975 | Turner | 417/87 |
| 4,183,425 | A | | 1/1980 | Sommer | |
| 4,408,961 | A | * | 10/1983 | Laybourne | 417/87 |
| 4,420,292 | A | | 12/1983 | Lutz | 418/32 |
| 4,488,852 | A | * | 12/1984 | Ivins et al. | 417/211.5 |
| 5,395,217 | A | | 3/1995 | Hoffmann et al. | 417/362 |
| 5,544,540 | A | | 8/1996 | Holman | |
| 6,106,240 | A | * | 8/2000 | Fischer et al. | 417/203 |
| 6,113,360 | A | * | 9/2000 | Yu et al. | 418/171 |
| 6,152,231 | A | | 11/2000 | Grenke | |
| 6,244,843 | B1 | * | 6/2001 | Kosuge | 418/171 |

FOREIGN PATENT DOCUMENTS

| | | | |
|---|---|---|---|
| DE | 19942 567 A1 | 9/1999 | 418/15 |
| EP | 0517014 A1 | 5/1992 | |
| FR | 2228961 | 12/1974 | |
| GB | 2110759 A | 6/1983 | |
| GB | 2150981 A | 11/1983 | |
| JP | 09203381 | 5/1997 | |

OTHER PUBLICATIONS

European Search Report dated Oct. 18, 2002, #EP02006215.4.
European Search Report dated Jul. 8, 2002, #EP02006215.
Pump Handbook Article by Igor J. Karassik, William C. Krutzsch, Warren H. Fraser & Joseph P. Messina.

* cited by examiner

*Primary Examiner*—Cheryl J. Tyler
(74) *Attorney, Agent, or Firm*—Rader, Fishman & Grauer PLLC

(57) ABSTRACT

A pump assembly is provided that includes a gerotor pump and a manifold. An aspirating member is positioned between a pump inlet cavity in the manifold and a fluid reservoir. Fluid flow generated by operation of the pump is diverted by a flow control valve and accelerates as it passes between the aspirating member and the manifold. The resulting decrease in static pressure draws the fluid out of the reservoir where it mixes with the higher velocity fluid. As the combined fluid is slowed, the static pressure increases to "supercharge" the inlet cavity to improve the inlet fill and reduce cavitation. An inlet port in the gerotor pump corresponds to the inlet cavity in the manifold. The timing and geometry of an input port is optimized to prevent noise inducing pressure spikes while maintaining sufficient back pressure in the pump chambers to collapse entrapped vapor bubbles in the fluid.

22 Claims, 7 Drawing Sheets

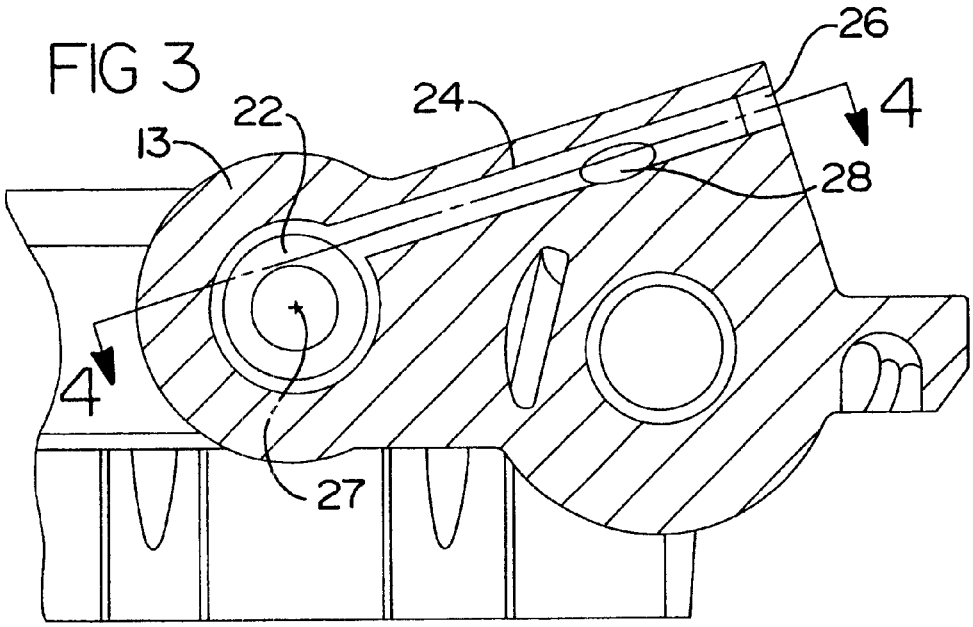
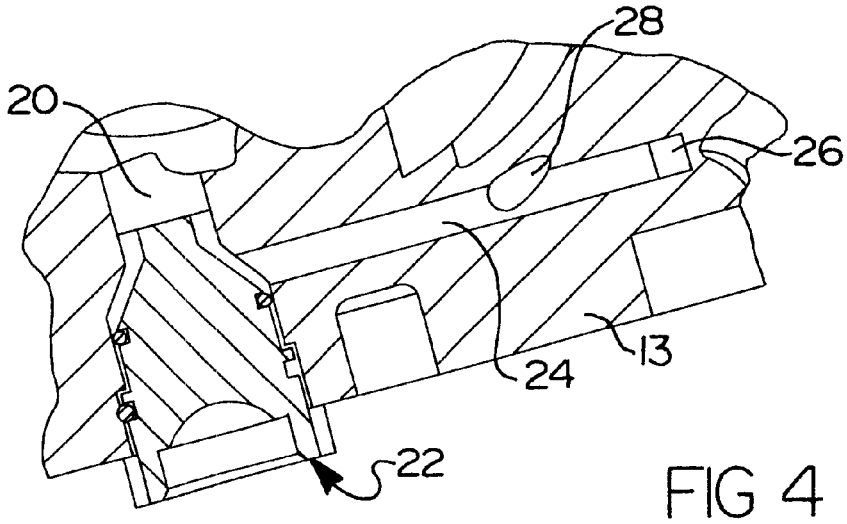
FIG 4

FIG 6
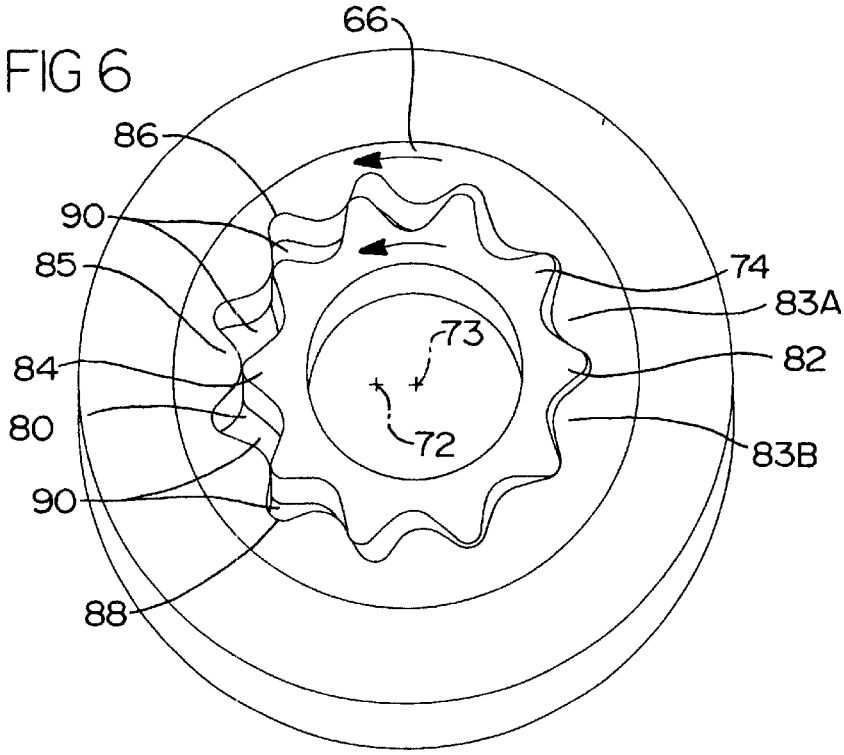
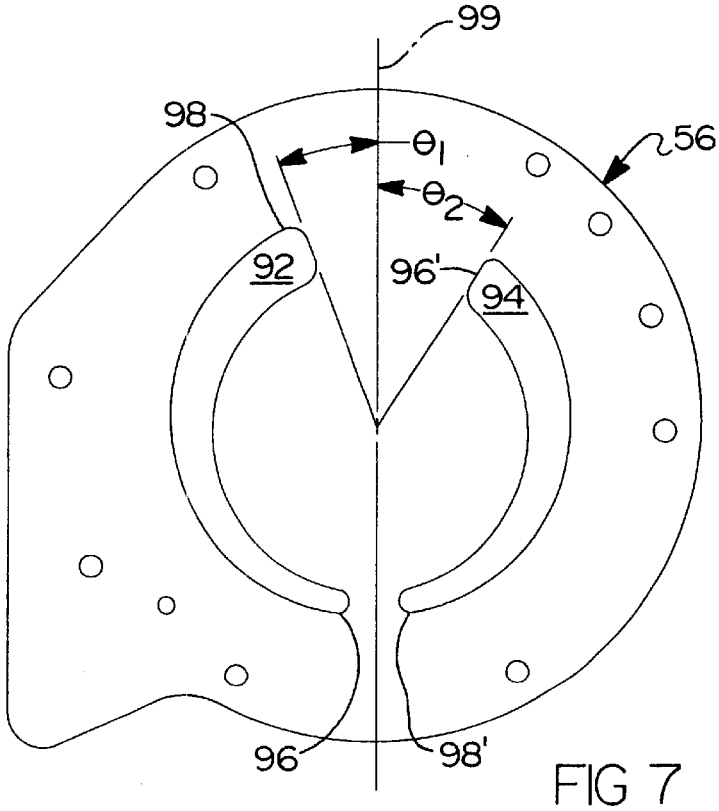
FIG 7

POSITIVE DISPLACEMENT FLUID PUMP HAVING IMPROVED FILL CHARACTERISTICS

FIELD OF THE INVENTION

The present invention relates generally to a positive displacement fluid pump and more specifically to a gerotor pump assembly suitable for use in hydraulic systems.

BACKGROUND OF THE INVENTION

In a positive displacement fluid pump commonly referred to as a gerotor pump, a ring gear and a pinion gear inside of the ring gear are supported in a pump housing for rotation about parallel, laterally separated centerlines. The teeth on the respective gears cooperate to define a plurality of variable volume pumping chambers whereupon during rotation of the gear members, a pumping chamber increases in volume to a maximum volume and then decreases in volume. Fluid from the relatively low pressure inlet port of the pump is drawn into pumping chambers that are increasing in volume. Upon further rotation of the gerotor when the pumping chambers are decreasing in volume, the fluid is pushed out through the outlet port of the pump at a relatively higher pressure. The inlet and the outlet ports are separated angularly or "timed" to prevent the pump chambers from simultaneously overlapping both the inlet port and the outlet port.

A common limitation exhibited by many gerotor pumps is excessive noise caused by cavitation (the rapid formation and collapse of bubbles in the pumped fluid). Cavitation in gerotor pumps is generally caused by the pump speed being greater than the time required to fill the pumping chambers. The incomplete charge of the pumping chambers entraps air or other vapor within the fluid. If not accounted for, the entrapped vapor bubbles collapse in the discharge port creating noise inducing pressure pulses that also decrease pump efficiency. The present invention provides a pump assembly with improved charging and timing conditions to reduce cavitation and resulting noise.

SUMMARY OF THE INVENTION

The present invention provides a new and improved positive displacement pump assembly with improved timing, porting geometry and inlet fluid mechanics to improve fill and reduce cavitation.

In accordance with an embodiment of the present invention, a pump assembly is provided that includes a gerotor pump and a manifold. An aspirating member is positioned between an inlet cavity in the manifold and a fluid reservoir proximate the pump assembly. High pressure fluid diverted by a flow control valve accelerates as it passes between the aspirating member and the manifold. The resulting lower static pressure draws the fluid out of the reservoir where it mixes with the relatively higher velocity diverted fluid. As the combined fluid is slowed, the static pressure increases to "supercharge" the inlet cavity resulting in an improvement in the inlet fill and a reduction in cavitation.

In accordance with another embodiment of this invention, a gerotor pump is provided with a plurality of pump chambers defined by the teeth of a ring gear and a pinion gear. The pumping chambers expand in an inlet half of a crescent-shaped cavity created between the ring gear and the pinion gear and collapse in a discharge half of the crescent-shaped cavity. An inlet port in a planar member faces the inlet half of the crescent-shaped cavity. A discharge port in the planar member faces the discharge half of the crescent-shaped cavity and is timed relative to the inlet port for pumping the fluid. The timing and geometry of the input port and output port are optimized to prevent noise inducing pressure spikes while maintaining sufficient back pressure in the pump chambers to collapse entrapped vapor bubbles in the fluid.

Various additional aspects and advantages of this invention will become apparent to those skilled in the art from the following detailed description of the preferred embodiment, when read in light of the accompanying drawings.

BRIEF DESCRIPTION OF THE DRAWINGS

The features and inventive aspects of the present invention will become more apparent upon reading the following detailed description, claims, and drawings, of which the following is a brief description:

FIG. 3 is a cross-sectional view of the manifold and aspirating member along the line 3—3 in FIG. 2.

FIG. 4 is a cross-sectional view of the manifold and aspirating member along the line 4—4 in FIG. 3.

FIG. 6 is a view of the gerotor pump showing a pinion gear and a ring gear positioned within a housing.

FIG. 7 is a view of a planar member showing an inlet port and a discharge port.

DESCRIPTION OF PREFERRED EMBODIMENTS

Figure 1:
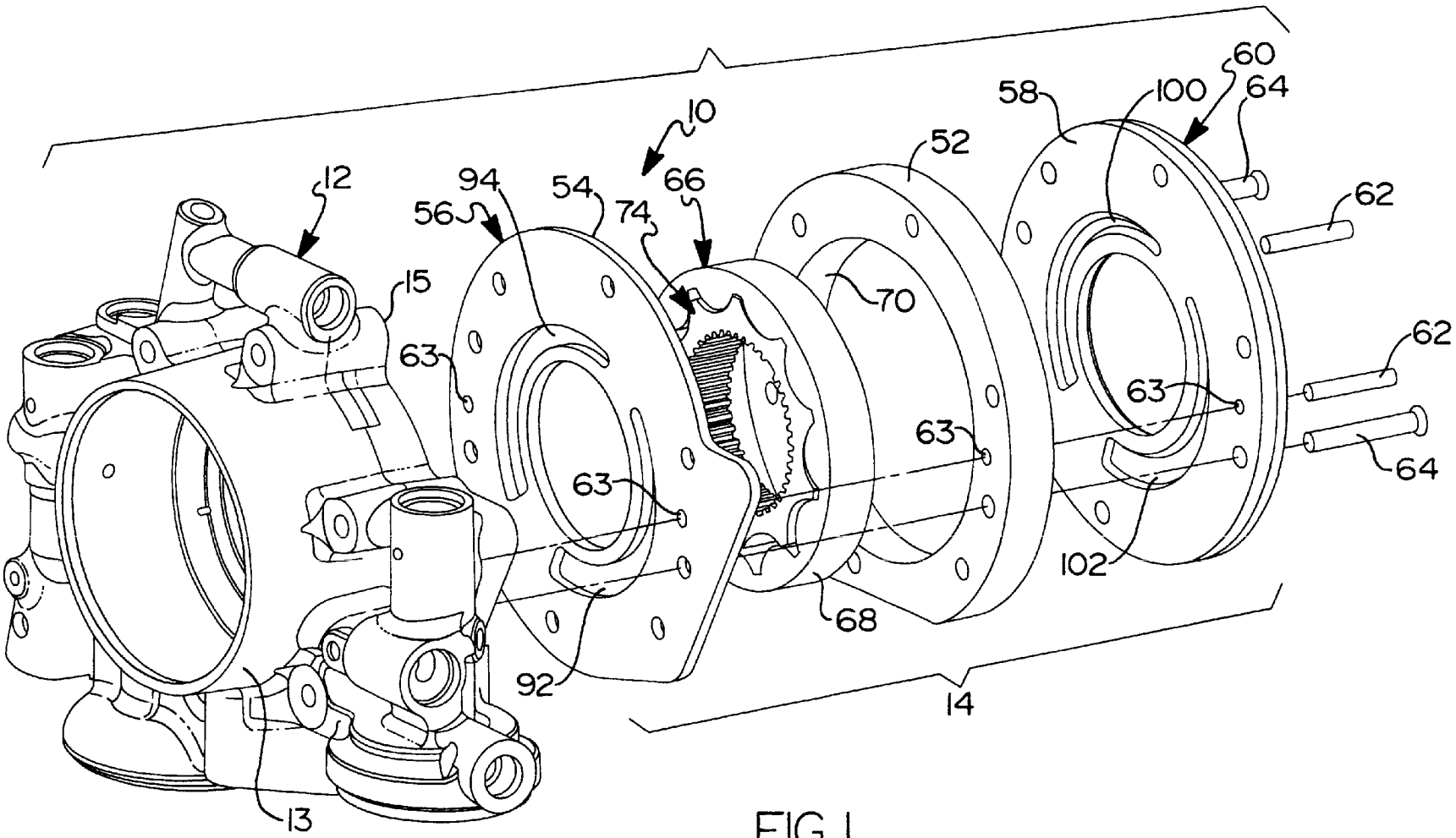
FIG. 1 is an exploded perspective view of an embodiment of the present invention showing a manifold and gerotor pump.

Referring now to the drawings, two preferred embodiments of the present invention are described in detail. Referring to FIG. 1, a preferred embodiment of the present invention is shown that includes a pump assembly 10, preferably for use in supplying fluid to a wet clutch and more preferably for use with a wet clutch of a motor vehicle. Pump assembly 10 generally includes a manifold 12 and a gerotor pump 14. Manifold 12 is placed in communication with a fluid reservoir (not illustrated) and is designed to route the flow of a fluid from the reservoir, through pump 14 and into a wet clutch (not illustrated).

Figure 2:
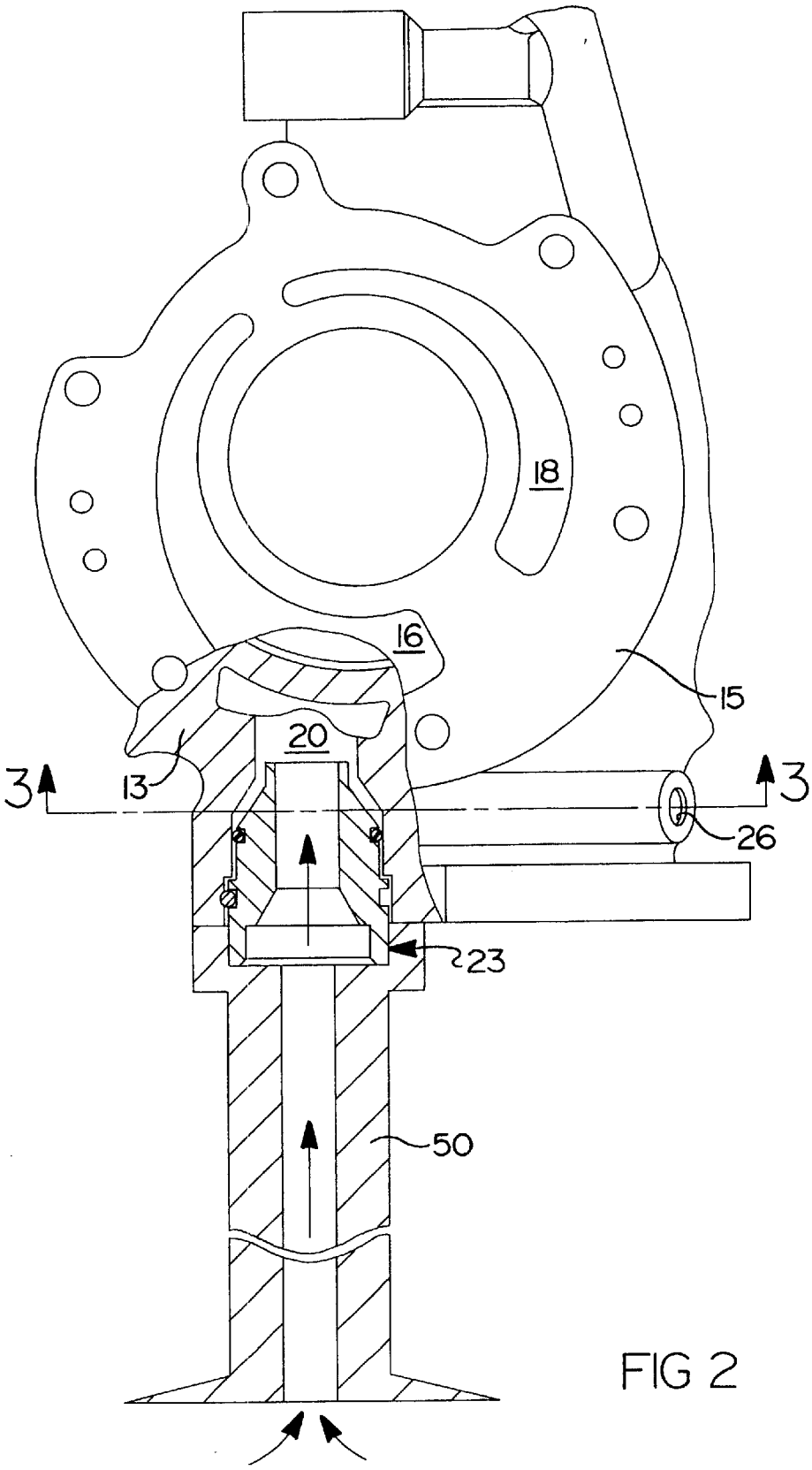
FIG. 2 is a partial sectional view of the manifold according to FIG. 1 showing an aspirating member according to a preferred embodiment.

Referring to FIGS. 1, 2 and 3, manifold 12 is preferably formed of a strong material, such as a steel or a high strength plastic, and generally includes a body 13 having a duct therethrough to allow passage of an input shaft (not illustrated) that transmits torque between a wet clutch and a transmission. Body 13 preferably includes a planar connecting structure 15 defining an inlet cavity 16 and an outlet cavity 18 therein. Manifold 12 further includes an intake port 20 that is preferably placed in direct communication with inlet cavity 16 and is designed to receive an aspirating member 22. As shown in FIGS. 3 and 4, a first duct 24 is preferably provided within body 13 that terminates on one end in intake port 20 and on the other end at an orifice 26. First duct 24 is preferably laterally offset to one side of a geometric center of aspirating member 22 to promote a vortex-like action in a fluid as the fluid flows from first duct 24 into intake port 20. A second duct 28 is preferably provided within body 13 that terminates on one end into first duct 24 and on the other end at an orifice (not illustrated). A flow control valve (not illustrated) is provided in the orifice to redirect a portion of the total fluid output of pump 14 in order to maintain the useful fluid output of pump 14 within a predetermined range. Fluid that is redirected by the flow control valve will flow through second duct 28 and first duct 24 into intake port 20.

Figure 5:
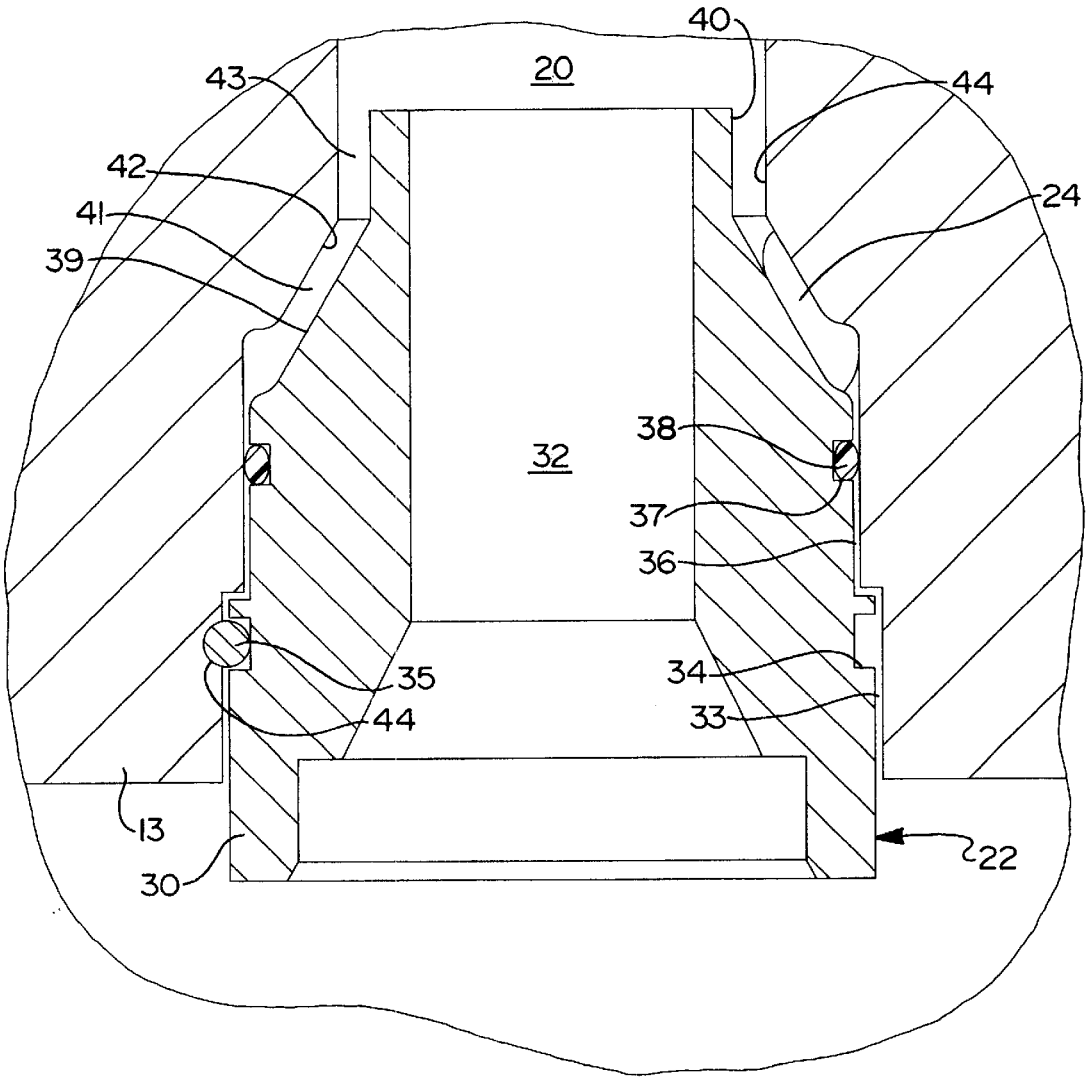
FIG. 5 is an enlarged cross-sectional view of the aspirating member according to FIG. 2.

Referring to FIG. 5, in a preferred embodiment, aspirating member 22 includes a generally cylindrical body 30 defining a duct 32 therethrough to allow passage of a fluid. Body 30 includes a first outer surface 33 preferably having a first annular cavity 34 disposed therein to receive a locking member 35, such as a rigid pin. A second outer surface 36 is provided having a diameter that is preferably smaller than first outer surface 33 and preferably includes a second annular cavity 37 disposed therein for receiving a sealing member 38, such as an o-ring. A radially contracting conical surface 39 extends from second outer surface 36 to a third outer surface 40 having a diameter that is preferably smaller than second outer surface 36. When aspirating member 22 is received in intake port 20, sealing member 38 in second annular cavity 37 sealingly engages a corresponding wall in intake port 20. Additionally, a first annular void 41 is created between conical surface 39 and a corresponding conical surface 42 in intake port 20. Similarly, a second annular void 43 is created between third outer surface 40 and a corresponding surface 44 in intake port 20. Voids 41 and 43 permit the free flow of fluid between aspirating member 22 and intake port 20 as the fluid enters intake 20 through first duct 24. Referring to FIGS. 2 and 5, aspirating member 22 is preferably secured in intake port 20 by inserting locking member 35 into the area formed between cavities 34 and 44. An inlet tube 50 is secured to manifold 12 proximate aspirating member 22 to provide communication between aspirating member 22 and a remote fluid reservoir. Inlet tube 50 is preferably attached to manifold 12 via a plurality of threaded fasteners (not illustrated). However, it is recognized that other methods of attachment known in the art, such as welding, may be utilized to secure inlet tube 50 to manifold 12.

Referring to FIGS. 1 and 6, pump 14 generally includes a housing 52 sandwiched between a flat inboard side 54 of a planar member 56 and a flat outboard side 58 of a cover 60. Relative rotation between housing 52, planar member 56 and cover 60 is prevented by a plurality of dowels 62 that are inserted through a plurality of commonly positioned apertures 63 in housing 52, planar member 56 and cover 60. A plurality of fasteners 64 positioned through cover 60, housing 52 and planar member 56 secure pump 14 to manifold 12. Pump 14 further includes a ring gear 66 having a cylindrical outside surface 68 that cooperates with a cylindrical inside surface 70 of housing 52 in supporting ring gear 66 for rotation about a first longitudinal centerline 72 parallel to and laterally separated from a second longitudinal centerline 73 of pump 14, as shown in FIG. 6. A pinion gear 74 of pump 14 is disposed inside of ring gear 66 and coupled to an input device (not illustrated) for rotation as a unit with the input device about second longitudinal centerline 73.

Referring to FIG. 6, the lateral separation between the first and second longitudinal centerlines 72, 73 defines a crescent-shaped cavity 80 between ring gear 66 and pinion gear 74. Cavity 80 is closed on opposite sides by flat inboard side 54 of planar member 56 and flat outboard side 58 of cover 60, respectively. The wedge-shaped ends of the crescent shaped cavity 80 are separated from each other by a tooth 82 on pinion gear 74 in full mesh with a pair of teeth 83A, 83B on ring gear 66. With counterclockwise rotation of ring gear 66 and pinion gear 74 as indicated by the directional arrows in FIG. 6, tooth 84 on pinion gear 74 cooperates with a tooth 85 on ring gear 66 in dividing the crescent-shaped cavity 80 into an inlet half 86 and a discharge half 88. The gear teeth on pinion gear 74 and ring gear 66 cooperate in defining a plurality of pump chambers 90 that expand in inlet half 86 of crescent-shaped cavity 80 and collapse in discharge half 88 of crescent-shaped cavity 80.

Referring to FIG. 7, an inlet port 92 in planar member 56 is disposed therethrough and faces inlet half 86 of crescent-shaped cavity 80. Upon assembly of pump 14, inlet port 92 is designed to communicate with the aforesaid fluid reservoir through inlet cavity 16 of manifold 12. Like crescent-shaped cavity 80, inlet port 92 is preferably crescent-shaped and more preferably includes a relatively narrow upstream end 96 that expands into a relatively wider downstream end 98. The expanding width of inlet port 92 is preferably sized to match the similarly expanding width of inlet half 86 of crescent-shaped cavity 80. A discharge port 94 in planar member 56 is disposed therethrough and faces discharge half 88 of crescent-shaped cavity 80. Discharge port 94 is preferably crescent-shaped and more preferably includes a relatively wide upstream end 96' that contracts into a more narrow downstream end 98'. Like inlet port 92, the narrowing width of discharge port 94 is preferably sized to match the similarly narrowing width of discharge half 88 of crescent-shaped cavity 80. Matching the width of inlet port 92 and discharge port 94 to the width of inlet half 86 and discharge half 88, respectively, maximizes the fill efficiency of pump 14. Discharge port 94 communicates with the aforesaid clutch through outlet cavity 18 in manifold 12. The timing between inlet port 92 and a top-dead-center 99 of pump 14 is characterized by an angle $theta_1$. The timing between top-dead-center 99 of pump 14 and discharge port 94 is characterized by an angle $theta_2$ In a preferred embodiment, theta, is in the range of approximately 0° to 17° and more preferably approximately 7°. $Theta_2$ is preferably in the range of approximately 0° to 37° and more preferably approximately 37°. In this configuration, the time inlet half 86 of crescent-shaped cavity 80 spends in communication with inlet port 92 is maximized such that inlet half 86 completely fills with fluid to prevent cavitation within pumping chambers 90.

Referring to FIG. 1, cover 60 preferably includes an inlet groove 100 characterized by geometry substantially similar to inlet port 92. Inlet groove 100 faces and therefore "shadows" inlet port 92 on the opposite side of crescent-shaped cavity 80 from inlet port 92. Similarly, a discharge groove 102 characterized by geometry substantially similar to discharge port 94 is preferably disposed in cover 60 facing discharge port 94 on the opposite side of crescent-shaped cavity 80 from discharge port 94. Grooves 100, 102 balance the pressure within crescent-shaped cavity 80 to reduce friction and prevent premature wear of the components.

Figure 8:
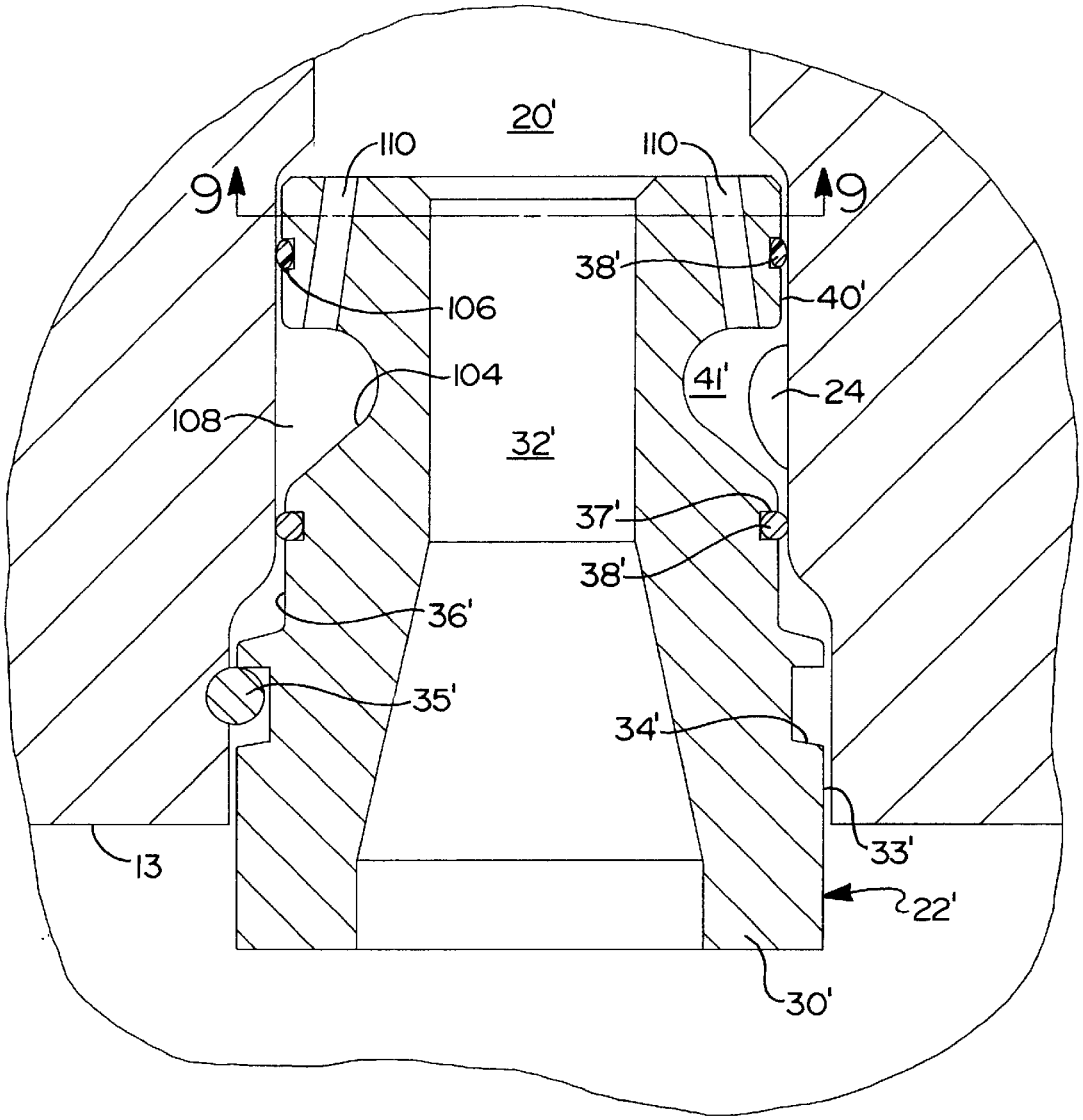
FIG. 8 is a cross-sectional view of a second embodiment of the aspirating member.
Figure 9:
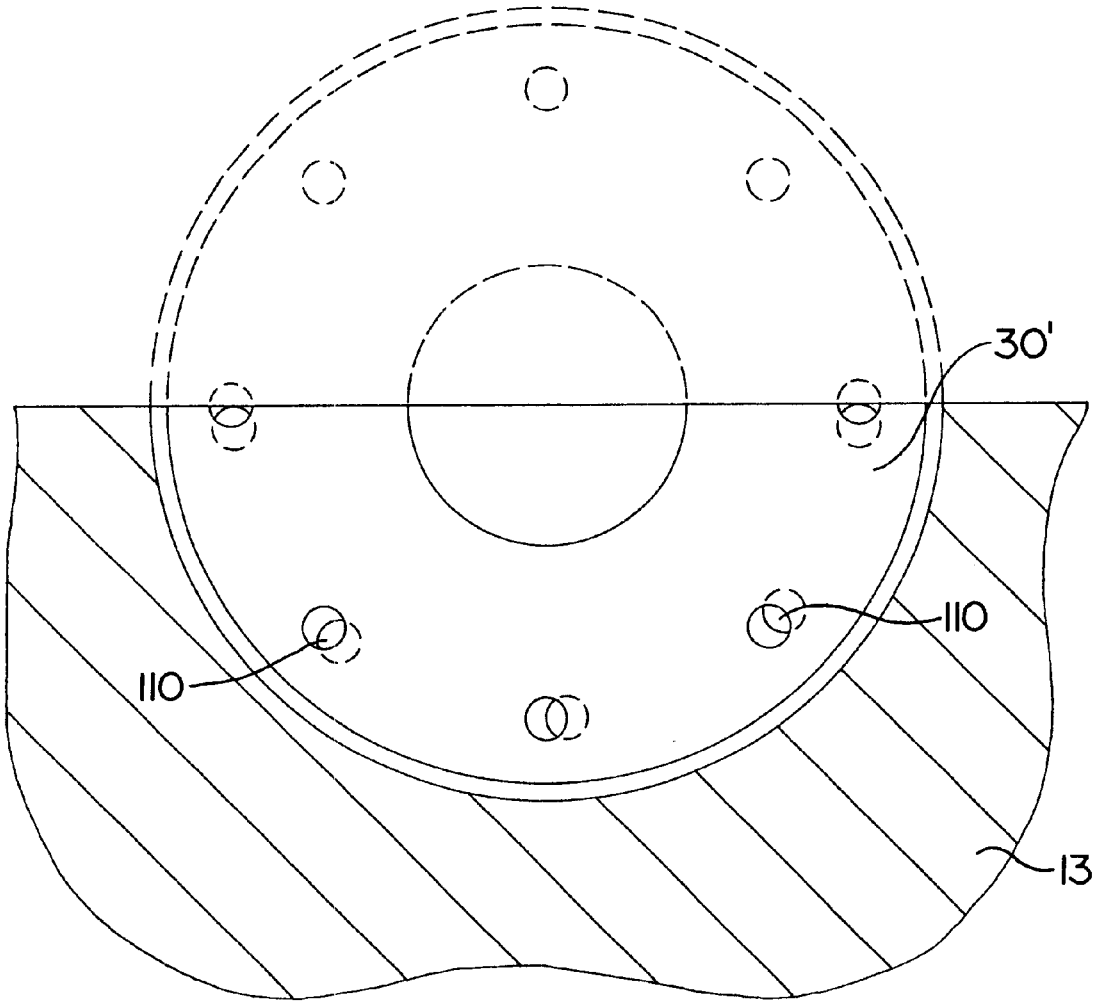
FIG. 9 is a cross-sectional view of the second embodiment of the aspirating member along the line 9—9 in FIG. 8.

Referring to FIG. 8, a second embodiment of an aspirating member 22' is provided having a generally cylindrical body 30' that includes a duct 32' therethrough to allow passage of a fluid from a fluid reservoir to inlet cavity 16 in manifold 12. Aspirating member 22' generally includes a first outer surface 33' preferably having a first annular cavity 34' disposed therein to receive a locking member 35'. Locking member 35' is preferably substantially similar in form and function to locking member 35 in the preferred embodiment of aspirating member 22. A second outer surface 36' is provided having a diameter that is preferably smaller than first outer surface 33' and more preferably includes a second annular cavity 37' for receiving a sealing member 38', such as an o-ring. An annular groove 104 extends from second outer surface 36' to a third outer surface 40' having a diameter that is preferably substantially similar to the diameter of second outer surface 36'. Third outer surface 40' preferably includes a third annular cavity 106 designed to receive a sealing member 38'. When aspirating member 22' is received in an intake port 20', sealing members 38' in cavities 37' and 106 sealingly engage a corresponding wall 108 in intake port 20'. Additionally, an annular void 41' is created between groove 104 and wall 108 in intake port 20'. Void 41' permits the free flow of fluid between aspirating member 22' and intake port 20' as the fluid enters intake port 20' through first duct 24. The fluid entering from first duct 24 is accelerated through a plurality of ducts 110 exiting at a relatively high velocity. Additionally, as shown in FIG. 9, ducts 110 may be slightly angled when viewed axially to enhance the vortex-like action in the fluid. The operation of aspirating member 22' is substantially similar in operation to the preferred embodiment of aspirating member 22, as described in further detail below.

Operation of the inventive pump assembly 10 will be described with reference to FIGS. 1, 3, 4, 5 and 6. Rotation of the input device (not illustrated) causes the pinion gear 74 and ring gear 66 to rotate. High pressure fluid diverted by the flow control valve (not illustrated) travels through second duct 28 and first duct 24 until it encounters aspirating member 22. The high pressure fluid is accelerated through voids 41 and 43 exiting at a relatively high velocity to create a relatively low static pressure at the outlet of aspirating member 22. The low static pressure at the outlet of aspirating member 22 works as a suction to draw in fluid from the reservoir through duct 32. Additionally, the offset of first duct 24 creates a vortex in the fluid as it passes through voids 41 and 43 to further amplify the pressure drop. The high velocity fluid mixes with the relatively lower velocity inlet fluid, thereby transferring the momentum of the high velocity fluid to the inlet fluid. The mix of fluid then enters inlet cavity 16 at a mean velocity that, when slowed in inlet cavity 16, results in an increase in the static pressure at the pump inlet. Operation of aspirating member 22 transfers fluid from the reservoir to inlet cavity 16 of pump 14 at a moderate charging pressure to suppress cavitation at the expanding pump chambers 90 of pump 14 in the inlet half 86 of the crescent-shaped cavity 80.

Inlet half 86 of crescent-shaped cavity 80 expands as it passes inlet cavity 16 and the corresponding inlet port 92 in planar member 56. The expanding pumping chambers 90 draw in the "supercharged" inlet flow as pumping chambers 90 traverse crescent-shaped cavity 80. The extended timing of inlet port 92 and "supercharged" inlet flow cooperate to permit pumping chambers 90 to completely fill with fluid. The extended timing and "supercharged" inlet flow alone operate to improve the volumetric efficiency of pump 14, even when no cavitation is present. Moreover, by removing upstream end 96' of outlet port 94 an angle of $theta_2$ from top-dead-center 99 of pump 14, the entering fluid is pre-compressed to reduce cavitation and resulting noise. As each of pumping chambers 90 traverses crescent-shaped cavity 80 from inlet half 86 to discharge half 88, the fluid in pumping chambers 90 is momentarily completely trapped to assure separation between inlet cavity 16 and outlet cavity 18. The fluid is expelled from the collapsing pump chambers 90 in discharge half 88 of crescent-shaped cavity 80 through discharge port 94 and into outlet cavity 18.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A positive displacement fluid pump assembly comprising:

a pumping unit that includes an outlet port and an inlet port, said inlet port being generally crescent-shaped and having a downstream end removed an angle $theta_1$ from a top-dead-center of said pumping unit, said outlet port being generally crescent-shaped having an upstream end removed an angle $theta_2$ from the top-dead-center of said pumping unit;

a manifold for directing fluid flow to and from said pumping unit; and an aspirating member positioned between a pump inlet cavity in said manifold and a fluid reservoir, said aspirating member having a duct therethrough to permit passage of a fluid from said reservoir into said inlet cavity.

2. A pump according to claim 1, wherein said aspirating member is received in said manifold.

3. A pump according to claim 2, wherein said aspirating member and said manifold define at least one void therebetween to permit passage of a portion of said fluid flow generated by said pumping unit into said variable volume pumping chamber.

4. A pump according to claim 2, wherein said aspirating member further includes at least one annular cavity having a sealing member disposed therein.

5. A pump according to claim 2, wherein said manifold further includes a supply duct to supply said portion of said fluid flow generated by said pumping unit to said aspirating member.

6. A pump according to claim 5, wherein said supply duct is laterally offset to one side of a central longitudinal axis of said aspirating member.

7. A pump according to claim 2, wherein said pumping unit includes a planar member having a generally crescent-shaped outlet port and a generally crescent-shaped inlet port disposed therethrough.

8. A pump according to claim 7, wherein said inlet port and outlet port in said planar member correspond to an inlet cavity and an outlet cavity in said manifold.

9. A positive displacement fluid pump comprising:

an outer ring gear rotatable in a housing of said pump about a first centerline; an inner pinion gear inside of said ring gear rotatable on said housing of said pump about a second centerline parallel to and separated from said first centerline so that a crescent-shaped cavity is defined between said ring gear and said pinion gear;

a pair of planar sides of said housing enclosing opposite sides of said crescent-shaped cavity;

a plurality of gear teeth on said ring gear and on said pinion gear cooperating in dividing said crescent-shaped cavity into an inlet half and a discharge half and into a plurality of pump chambers traversing said crescent-shaped cavity from said inlet half to said discharge half;

an inlet port in a first one of said pair of planar sides of said housing facing said inlet half of said crescent-shaped cavity, said inlet port having a downstream end that is separated angularly from a top-dead-center of said pump by a timing angle $theta_1$;

a discharge port in said first one of said pair of planar sides of said housing facing said discharge half of said crescent-shaped cavity, said outlet port having an upstream end that is separated angularly from said top-dead-center by a timing angle $theta_2$; and wherein said angle $theta_1$ is in a range of approximately 0° to 17°.

10. A pump according to claim 9, wherein said angle $theta_1$ is approximately 7°.

11. A pump according to claim 9, wherein said angle $theta_2$ is in a range of approximately 0° to 37°.

12. A pump according to claim 11, wherein said angle $theta_2$ is approximately 37°.

13. A positive displacement fluid pump assembly comprising:

a pumping unit;

a manifold for directing fluid flow into and from said pumping unit; and an aspirating member positioned between said pumping unit and a fluid reservoir, said aspirating member configured to create a vortex in the fluid flow directed into said pumping unit from said reservoir.

14. A pump according to claim 13, wherein said pumping unit includes an inlet cavity, said aspirating member includes at least one duct that directs fluid flow from said pumping unit into said inlet cavity, said duct being angled to create the vortex in the fluid flow entering said inlet cavity.

15. A pump according to claim 13, wherein said pumping unit includes an inlet cavity, said manifold includes a supply duct to direct a portion of the fluid flow generated by said pumping unit to said aspirating member, said supply duct being laterally offset to one side of a central longitudinal axis of said aspirating member to create the vortex in the fluid flow entering said inlet cavity.

16. A positive displacement fluid pump assembly comprising:

a pumping unit having at least one variable volume pumping chamber and a planar member having an outlet port and an inlet port disposed therethrough, said inlet port being generally crescent shaped having a downstream end removed an angle $theta_1$ from a top-dead-center of said pumping unit;

a manifold for directing fluid flow to and from said pumping unit; and an aspirating member positioned between a pump inlet cavity in said manifold and a fluid reservoir, said aspirating member having a duct therethrough to permit passage of a fluid from said reservoir into said at least one variable volume pumping chamber of said pumping unit.

17. A pump according to claim 16, wherein said angle $theta_1$ is in a range of approximately 0° to 17°.

18. A pump according to claim 17, wherein said angle $theta_1$ is approximately 7°.

19. A positive displacement fluid pump assembly comprising:

a pumping unit having at least one variable volume pumping chamber and a planar member having an outlet port and an inlet port disposed therethrough, said outlet port is generally crescent shaped having an upstream end removed an angle $theta_2$ from a top-dead-center of said pumping unit;

a manifold for directing fluid flow to and from said pumping unit; and an aspirating member positioned between a pump inlet cavity in said manifold and a fluid reservoir, said aspirating member having a duct therethrough to permit passage of a fluid from said reservoir into said at least one variable volume pumping chamber of said pumping unit.

20. A pump according to claim 19, wherein said angle $theta_2$ is in a range of approximately 0° to 37°.

21. A pump according to claim 20, wherein said angle $theta_2$ is approximately 37°.

22. A positive displacement fluid pump assembly for use in supplying a fluid to operate a wet clutch assembly, said pump assembly comprising:

a gerotor pump having an outer ring gear rotatable in a housing of said pump about a first centerline, an inner pinion gear inside of said ring gear rotatable on said housing of said pump about a second centerline parallel to and separated from said first centerline so that a crescent-shaped cavity is defined between said ring gear and said pinion gear, a pair of planar sides of said housing closing opposite sides of said crescent-shaped cavity, a plurality of gear teeth on said ring gear and on said pinion gear cooperating in dividing said crescent-shaped cavity into an inlet half and a discharge half and into a plurality of pump chambers traversing said crescent-shaped cavity from said inlet half to said discharge half, an inlet port in a first one of said pair of planar sides of said housing facing said inlet half of said crescent-shaped cavity, said inlet port having a downstream end that is separated angularly from a top-dead-center of said pump by a timing angle theta, that exceeds zero degrees, and a discharge port in said first one of said pair of planar sides of said housing facing said discharge half of said crescent-shaped cavity, said outlet port having an upstream end that is separated angularly from said top-dead-center by a timing angle $theta_2$ that exceeds zero degrees;

a manifold secured to said gerotor pump for directing fluid flow to and from said gerotor pump, said manifold including a port designed to receive an aspirating member, said aspirating member having a duct therethrough to permit passage of a fluid from a reservoir into an pump inlet cavity in said manifold; and wherein said aspirating member and said manifold define at least one void therebetween to permit passage of a portion of said fluid flow generated by said gerotor pump into said inlet cavity.

* * * * *

UNITED STATES PATENT AND TRADEMARK OFFICE

CERTIFICATE OF CORRECTION

PATENT NO. : 6,572,339 B2 
DATED : June 3, 2003
INVENTOR(S) : Erlen B. Walton et al.

It is certified that error appears in the above-identified patent and that said Letters Patent is hereby corrected as shown below:

Title page,
Item [75], Inventors, please change "Erlen Ba. Walton" to -- Erlen B. Walton --

Column 8,
Line 43, change "theta," to -- $theta_1$ --

Signed and Sealed this

Fifteenth Day of February, 2005

JON W. DUDAS
*Director of the United States Patent and Trademark Office*